US005693445A

United States Patent [19]

Yamaga et al.

[11] Patent Number: 5,693,445

[45] Date of Patent: Dec. 2, 1997

[54] ELECTROSTATIC IMAGE DEVELOPING TONER

[75] Inventors: Hiroyoshi Yamaga; Noboru Akuzawa; Nobuo Suzuki, all of Kawasaki, Japan

[73] Assignee: Hodogaya Chemical Co., Ltd., Kawasaki, Japan

[21] Appl. No.: 752,895

[22] Filed: Nov. 20, 1996

[30] Foreign Application Priority Data

Jul. 29, 1996 [JP] Japan ..... 8-214957

[51] Int. Cl.[6] ..... G03G 9/097

[52] U.S. Cl. ..... 430/110

[58] Field of Search ..... 430/110, 106

[56] References Cited

U.S. PATENT DOCUMENTS 5,244,764 9/1993 Uno et al. ..... 430/110

FOREIGN PATENT DOCUMENTS

| | | |
|---|---|---|
| 0 248 0176 | 5/1987 | European Pat. Off. . |
| 2 248 540 | 10/1974 | France . |
| 48-25669 | 7/1973 | Japan . |
| 59-188000 | 9/1984 | Japan . |
| 62-278571 | 12/1987 | Japan . |
| 6-214428 | 8/1994 | Japan . |

*Primary Examiner*—John Goodrow
*Attorney, Agent, or Firm*—Foley & Lardner

[57] ABSTRACT

Disclosed herein is an electrostatic image developing toner, which comprises a binder resin, a colorant and a charge control agent, wherein the charge control agent is a hydrophobicity-imparted product of a xanthene-type dye, which is represented by the formula

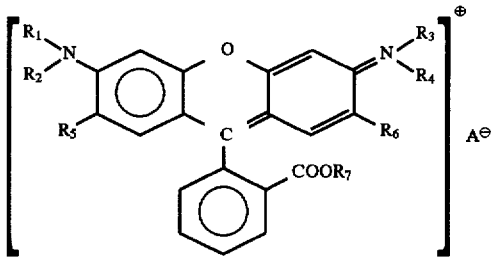

(1)

wherein $R_1$, $R_3$, $R_5$, $R_6$ and $R_7$ are independently hydrogen or a lower alkyl group, $R_2$ and $R_4$ are independently a lower alkyl group, and A is a group represented by the formula

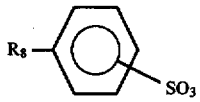

(2)

in which $R_8$ is a $C_{8-37}$ alkyl group, or the formula

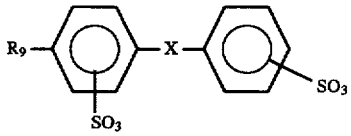

(3)

in which $R_9$ is a $C_{1-37}$ alkyl group, and X is O, S, NH or $CH_2$, and is contained in a proportion of 0.05 to 10 parts by weight per 100 parts by weight of the binder resin.

15 Claims, No Drawings

ELECTROSTATIC IMAGE DEVELOPING TONER

BACKGROUND OF THE INVENTION

1. Field of the Invention

The present invention relates to an electrostatic image developing toner, which contains a charge control agent useful for toners which are developers for electrophotography.

2. Related Background Art

In electrophotography, it is common to form an electrostatic latent image on a photoconductor layer constructed by a photoconductive material or the like, develop this latent image with a powder toner to make visible, and further fix the visible image with heat or a solvent.

Since the photoconductor layer can be charged positively or negatively, an electrostatic latent image positively or negatively charged is obtained by exposure under the original. When an electrostatic latent image negatively charged is developed with a developer powder positively charged, therefore, a positive—positive image conforming with the original is formed.

As a developer for such electrophotography, there is used a mixture of fine powder called a toner, composed of a binder resin and a colorant, and minute iron powder or ferrite powder called a carrier.

The powder toner is generally obtained by heating and melting a binder resin, which is an essential component, adding carbon black as a colorant and a charge control agent into the melt, dispersing the added components in the melt by kneading, cooling the dispersion, mechanically grinding the dispersion and then classifying the ground product.

A latent image on a photosensitive member is developed with a toner in accordance with a mechanism that the toner is charged by rubbing it with a carrier (in case of a two-component type developer) or by rubbing it with a sleeve (in case of a one-component type developer). Since the toner is consumed by the development, it is always replenished. However, the replenished toner has no electric charge, so that it is charged up to a predetermined charge level by stirring it within a developing part or rubbing it with the sleeve. The charge level of the toner is often preset to about 10 to 30 μC/g.

It is a matter of the most importance to the toner that the charge properties of the toner is controlled. The charge properties of the toner are controlled by a binder resin which is a main component of the toner. However, it is generally conducted to add a charge control agent to the toner, thereby achieving desired triboelectric properties. On demand for higher image quality, reliability and speeding-up in recent years, it is necessary to control a charge more precisely than before. There is hence a strong demand for development of a charge control agent, which can make build-up of charge faster and is stable to environment and changes with time.

It is one of properties required of a toner for satisfactorily conducting development that the charge of a replenished toner is built up to a predetermined charge level as fast as possible. If the toner is poor in build-up, a low-charged toner is generated, so that it is not sufficiently moved to a photosensitive member, which forms the cause of reduced density. In addition, the toner flies to cause scumming on a copied product and staining in a copying machine, and facilitate the deterioration of a developer, i.e., the toner.

In the case where the toner is used in a low-speed copying machine, such problems can be covered to some extend with stirring it within a developing part. However, the higher the machine speed, the toner is required to make build-up of charge faster because the replenished toner must be more quickly moved from the developing part to the photosensitive member. In the case of a one-component type toner, a charge must be generated by only rubbing with the sleeve, not by rubbing with the carrier. A build-up property is therefore more important to the one-component type toner than to the two-component type toner.

Oil Black, Nigrosine (Japanese Patent Publication No. 48-25669), Aniline Black, Crystal Violet and the like have heretofore been proposed as charge control agents.

However, the proposed charge control agents are not easily mixed with a binder resin when preparing a toner for reasons of their poor compatibility with the binder resin. Therefore, various problems are left on various properties of the toner. A charge control agent composed of a Rhodamine-type dye and molybdate tungstate phosphate has been known from Japanese Patent Application Laid-Open No. 6-214428, and a charge control agent composed of a Rhodamine-type dye and p-toluenesulfonic acid has been known from Japanese Patent Application Laid-Open No. 62-278571. These charge control agents also leave similar problems.

In the case of a toner, it is very important in particular to evenly disperse a charge control agent in a binder resin. If the dispersibility is poor, the charge control agent cannot be evenly mixed into toner particles, so that the resulting toner becomes uneven in quality and easy to undergo reduction of build-up of charge and a change with time. Toners obtained by using the above-described charge control agents leave a problem of exhibiting such behavior that its charge becomes unstable under high-temperature and high-humidity conditions. Therefore, they are not yet satisfactory for charge control agents for toners.

SUMMARY OF THE INVENTION

It is an object of the present invention to provide a toner containing a high-performance charge control agent or a charge control agent composition therein, which the toner can solve the above-described problems involved in the prior art, is good in build-up of charge and can reproduce an image stably over a long period of time without being affected by changes of temperature and humidity even when repeatedly conducting development by continuously using it.

The present inventors have carried out various investigations with a view toward solving the above-described problems. As a result, it has been found that a hydrophobicity-imparted product of a specific xanthene-type dye, which is a charge control agent, or a modified charge control agent composition prepared from the hydrophobicity-imparted product of the xanthene-type dye and a specific inorganic pigment has a feature that its dispersibility in resins is extremely good, and have ascertained that toners making use of these agents can solve the above-described problems, i.e., can make build-up of charge faster, improve stability to charging performance and prevent flying of the toner and occurrence of image defects, thus leading to completion of the present invention. The above object can be achieved by the present invention described below.

According to the present invention, there is thus provided an electrostatic image developing toner, which comprises a binder resin, a colorant and a charge control agent, wherein the charge control agent is a hydrophobicity-imparted product of a xanthene-type dye, which is represented by the general formula

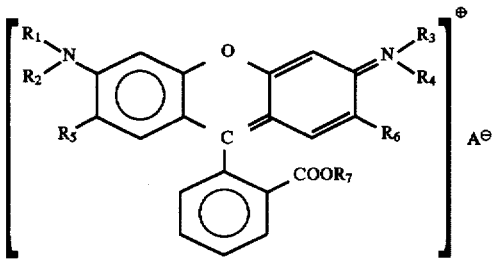

(1)

wherein $R_1$, $R_3$, $R_5$, $R_6$ and $R_7$ are independently hydrogen or a lower alkyl group, $R_2$ and $R_4$ are independently a lower alkyl group, and A is a group represented by the general formula

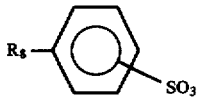

(2)

in which $R_8$ is an alkyl group having 8 to 37 carbon atoms, preferably an alkyl group having 8 to 20 carbon atoms, or the general formula

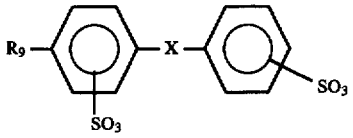

(3)

in which $R_9$ is an alkyl group having 1 to 37 carbon atoms, preferably an alkyl group having 8 to 20 carbon atoms, and X is O, S NH or $CH_2$, preferably O, and is contained in a proportion of 0.05 to 10 parts by weight per 100 parts by weight of the binder resin.

According to the present invention, there is also provided an electrostatic image developing toner, which comprises a binder resin, a colorant and a charge control agent, wherein the charge control agent is prepared from a hydrophobicity-imparted product of a xanthene-type dye, which is represented by the general formula (1), and an inorganic pigment, and is contained in a proportion of 0.05 to 10 parts by weight per 100 parts by weight of the binder resin.

DESCRIPTION OF THE PREFERRED EMBODIMENTS

In the toner according to the present invention, the hydrophobicity-imparted product of the xanthene-type dye may be used singly as a charge control agent, or in the form of a charge control agent composition prepared by mixing it with an inorganic pigment. It may be used in combination with any existing charge control agent.

The hydrophobicity-imparted product of the xanthene-type dye can be obtained by dissolving the xanthene-type dye in hot water or a proper solvent and adding an aqueous solution of a hydrophobicity-imparting agent, for example, sodium dodecylbenzenesulfonate, into this solution to react both compounds.

The charge control agent composition according to the present invention is prepared from the hydrophobicity-imparted product of the xanthene-type dye and an inorganic pigment. As a process for preparing the charge control agent composition, any process may be used so far as a homogeneous composition of both components can be obtained thereby.

It is preferable to add the inorganic pigment in any stage of a production process upon the preparation of the hydrophobicity-imparted product of the xanthene-type dye, thereby obtaining a homogeneous composition of the hydrophobicity-imparted product of the xanthene-type dye and the inorganic pigment as a final product in the form of a reaction product.

As illustrative inorganic pigments used in the present invention, may be mentioned calcium carbonate, magnesium carbonate, barium sulfate, calcium sulfate, magnesium hydroxide, aluminum hydroxide, calcium silicate, aluminum silicate, zinc silicate and magnesium silicate. These inorganic pigments may be used either singly or in any combination thereof.

As the inorganic pigment, there may be used either a synthetic product or a natural substance. Inorganic pigments subjected to a coating treatment with an organic compound, an organic polymer, a hydrophobicity-imparting agent, a titanate coupling agent or the like may also be used.

It is particularly preferable to add the inorganic pigment so that it is present together with starting materials for reaction in a reaction system for preparing the hydrophobicity-imparted product of the xanthene-type dye.

The inorganic pigment may also be added to a reaction mixture which will be transferred from a reaction step for producing the hydrophobicity-imparted product to a purification step thereof, or mixed with a filtration product in the form of a wet cake obtained from the purification step to add it.

There may be taken a process to prepare a homogeneous composition by filtering the hydrophobicity-imparted product formed by the reaction in the purification step, and drying the product, and thereafter, adding the inorganic pigment to the dried product immediately after the drying, and grinding and mixing the resultant mixture.

It is also possible to homogeneously mixing the hydrophobicity-imparted product dried and the inorganic pigment by a wet process in a suitable solvent, for example, water, a mixture of water and an organic solvent or an organic solvent alone, thereby obtaining a charge control agent composition having the same performance.

The charge control agent composition obtained by any one of the above-described processes and composed of the hydrophobicity-imparted product of the xanthene-type dye and the inorganic pigment may be used in the production of a toner as it is after dried. It may be used after further ground and classified as needed.

The content of the inorganic pigment in the charge control agent composition obtained by the present invention may be such that the properties as a charge control agent of the charge control agent composition are not deteriorated.

The charge control agent and charge control agent composition according to the present invention as described above have good dispersibility in the binder resin. A toner obtained by using the charge control agent or the charge control agent composition is good in build-up of charge and can solve the problems of unstable charging and flying of toner, which have heretofore been offered, even when used for a long period of time in an environment of low-temperature and low-humidity or high-temperature and high-humidity. As a result, a bright developed image can be obtained.

In a general production process of a powder toner, the temperature at which the binder resin is heated and melted is generally 150° C. or lower though it varies according to the kind of the resin used. The charge control agent is dispersed in such a melt by kneading. The charge control agent is required as its properties to have a melting point not lower than a kneading temperature and an extremely low solubility in the binder resin. The charge control agent dispersed in the resin has been known to be dispersed in the form of minute particles in individual toner particles obtained by grinding and classification.

Accordingly, when the charge control agent is prepared, it is important to design so as to bring out its properties to the maximum.

The amount of the charge control agent, which is the hydrophobicity-imparted product of the xanthene-type dye, or the charge control agent composition composed of the hydrophobicity-imparted product and the inorganic pigment is suitably 0.05 to 10 parts by weight, preferably 0.2 to 10 parts by weight, particularly preferably 0.5 to 5 parts by weight per 100 parts by weight of the binder resin.

The toner according to the present invention further comprises a binder resin and a colorant in addition to the charge control agent or the charge control agent composition.

Examples of the binder resin suitably used in the toners according to the present invention include polymers of styrene and substituted products thereof, such as polystyrene and polyvinyltoluene, styrene-substituted styrene copolymers, styrene-acrylic ester copolymers, styrene-methacrylic acid copolymers, styrene-acrylonitrile copolymer, polyvinyl chloride; polyethylene-silicone resins, polyester, polyurethane, polyamide, epoxy resins, modified rosins and phenol resins. However, any other resins which have hitherto been used as binder resins for toners may also be used. The charge control agent according to the present invention can impart good charging performance irrespective of particular resin properties.

Examples of the colorant include C.I. Pigment Black 1, C.I. Solvent Black 3, C.I. Solvent Black 22 and carbon black. However, any other colorants which have heretofore been used as colorants for toners may also be used.

The powder toner according to the present invention can be prepared either by melting and mixing the charge control agent or the charge control agent composition with the binder resin within a range of from 0.05 to 10 parts by weight per 100 parts by weight of the binder resin, solidifying the molten mixture, roughly grinding the solidified mixture by a hammer mill or another grinding machine, finely grinding the roughly ground product by a let mill and then classifying the finely ground product by an air classifier or by adding a polymerization initiator to a monomer, which is a starting material for the binder resin, adding the charge control agent or the charge control agent composition to this monomer within a range of from 0.05 to 10 parts by weight per 100 parts by weight of the monomer and conducting polymerization while suspending the resultant mixture in water. At this time, another colorant, carbon black or the like may be added as a coloring material. The charge control agent or the charge control agent composition according to the present invention can impart good charging performance irrespective of toner particles having a particular particle size distribution.

The toner produced in the above-described manner is charged to a charge level suitable for the development of an electrostatic latent image by rubbing with the carrier, and the charge level is kept constant without being affected by changes of temperature and humidity even when conducting development repeatedly for a long period of time. Its charge distribution is also even and kept constant.

As the carrier, there may be used carriers obtained by coating a magnetic core such as iron powder or ferrite with a styrene-methyl methacrylate copolymer, a silicone resin, a mixture of a styrene-methyl methacrylate copolymer and a silicone resin, a fluororesin such as a polymer of styrene tetrafluoride, and the like.

The charge control agent or charge control agent composition according to the present invention can impart excellent charge properties even when it is used in the so-called one-component type toner containing a magnetic substance. It may also be used in an encapsulated toner and a polymer toner. Further, it can also impart excellent charging performance to a non-magnetic one-component type toner.

Examples of magnetic materials used as the magnetic substance include fine powders of metals such as iron, nickel and cobalt, alloys of metals such as iron, cobalt, copper, aluminum, nickel and zinc, metal oxides such as aluminum oxide, iron oxides and titanium oxides, ferrites of iron, manganese, nickel, cobalt, zinc and the like, nitrides such as vanadium nitride and chromium nitride, carbides such as tungsten carbide and silicon carbide, and mixtures thereof.

Preferred magnetic substances are iron oxides such as magnetite, hematite and ferrite. The charge control agent according to the present invention can impart good charging performance irrespective of particular magnetic properties.

Preparation examples of the charge control agent and the charge control agent composition and application examples as the toner will hereinafter be mentioned as Examples to specifically describe the present invention. However, this invention is not limited to these examples. Incidentally, all designations of "part" or "parts" as to components as will be used in the following examples mean part or parts by weight unless expressly noted.

EXAMPLE 1

In 540 parts of hot water of 80° to 90° C., 18.8 parts of Rhodamine 6GCPN were dissolved under stirring. After 31.0 parts of aluminum silicate (OS-Clay, trade name, product of Sanyo Cray K.K.) were added to the solution, a solution composed of 14.0 parts of sodium dodecylbenzenesulfonate and 150 parts of water was poured. A red solid matter precipitated was separated by filtration and thoroughly washed with water. The solid matter was dried to obtain 59.8 parts of Composition 1 composed of a hydrophobicity-imparted product of the Rhodamine dye, which is represented by the following formula (4), and aluminum silicate.

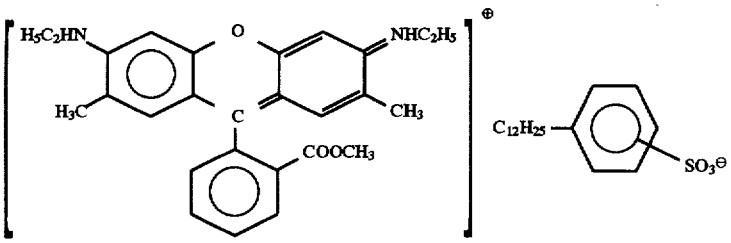

(4)

Then, 88 parts of a styrene-n-butyl methacrylate copolymer resin (Himer SBM-73F, trade name, product of Sanyo Chemical Industries, Ltd.) and 5 parts of low-molecular weight polypropylene (Viscol 550-P, trade name, product of Sanyo Chemical Industries, Ltd.), 5 parts of carbon black (#44, trade name, product of Mitsubishi Chemical K.K.) and 2 parts of Composition 1 were premixed, and then melted and kneaded. The thus-obtained melt was further ground and classified to obtain a toner having a particle diameter of 5 to 25 μm.

To 3 parts of the toner 97 parts of a carrier composed of iron powder (TEFV 200/300, trade name, product of Powdertech Corp.) was mixed to prepare a developer. After the developer was stirred, its triboelectric charge level was measured by means of a blow-off charge meter (manufactured by Toshiba Chemical Corporation). As a result, its charge level was found to be +20 μC/g.

The toner was charged into a developing device to conduct continuous copying, thereby performing an image test. As a result, it was found that a good image was obtained at the time of starting, its image quality remains unchanged even after copying of 50,000 sheets, and neither flying of the toner nor occurrence of offset was caused. Further, the same image quality as in the ordinary-temperature and ordinary-humidity environment was attained even in both high-temperature and high-humidity environment of 35° C. and 85% RH and low-temperature and low-humidity environment of 10° C. and 30% RH. Neither flying of the toner nor occurrence of offset was also caused even in such environments.

EXAMPLE 2

In 540 parts of hot water of 80° to 90° C., 18.8 parts of Rhodamine 6GCPN were dissolved under stirring. After 31 parts of aluminum silicate (OS-Clay, trade name, product of Sanyo Cray K.K.) were added to the solution, a solution composed of 10.9 parts of sodium dodecylbenzene-biphenyl ether disulfonate and 150 parts of water was poured. A red solid matter precipitated was separated by filtration and thoroughly washed with water. The solid matter was dried to obtain 60.7 parts of Composition 2 composed of a hydrophobicity-imparted product of the Rhodamine dye, which is represented by the following formula (5), and aluminum silicate.

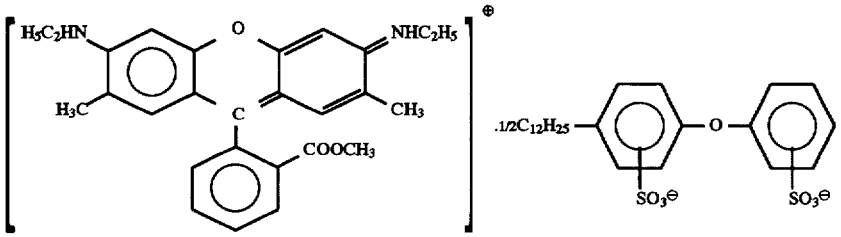

(5)

After a toner was then prepared in the same manner as in Example 1 except that Composition 1 was changed to Composition 2, its triboelectric charge level was measured. As a result, its charge level was found to be +19.2 μC/g.

The toner was charged into a developing device to conduct continuous copying, thereby performing an image test. As a result, it was found that a good image was obtained at the time of starting, its image quality remains unchanged even after copying of 50,000 sheets, and neither flying of the toner nor occurrence of offset was caused. Further, the good image quality was attained without being affected by both high-temperature and high-humidity environment and low-temperature and low-humidity environment.

EXAMPLE 3

A toner having a particle diameter of 5 to 25 μm was obtained by using Composition 1 and conduct the same treatment as in Example 1 except that the composition of the raw materials for the preparation of the toner was changed to the following composition:

| | |
|---|---|
| Polyester resin (HP-313, trade name, product of The Nippon Synthetic Chemical Industry Co., Ltd.) | 88 parts |
| Low-molecular weight polypropylene (Viscol 550-P, trade name, product of Sanyo Chemical Industries, Ltd.) | 5 parts |
| Carbon black (ELFTEX-8, trade name, product of Cabot Company) | 5 parts |
| Composition 1 | 2 parts |

To 3 parts of the toner 97 parts of a carrier composed of iron powder (TEFV 200/300, trade name, product of Powdertech Corp.) was mixed to prepare a developer. After the developer was stirred, its triboelectric charge level was measured by means of a blow-off charge meter (manufactured by Toshiba Chemical Corporation). As a result, its charge level was found to be +18.0 μC/g.

The toner was charged into a developing device to conduct continuous copying, thereby performing an image test. As a result, it was found that a good image was obtained at the time of starting, its image quality remains unchanged even after copying of 50,000 sheets, and neither flying of the toner nor occurrence of offset was caused. Further, the good image quality was attained without being affected by both high-temperature and high-humidity environment and low-temperature and low-humidity environment.

EXAMPLE 4

A toner was prepared in accordance with Example 3 except that Composition 1 was changed to Composition 2 and its triboelectric charge level was measured. As a result, its charge level was found to be +18.0 μC/g. When an image test was conducted, a good image quality was attained.

EXAMPLE 5

In 540 parts of hot water of 80° to 90° C., 18.8 parts of Rhodamine 6GCPN were dissolved under stirring. After 28.4 parts of aluminum silicate (OS-Clay, trade name, product of Sanyo Cray K.K.) were added to the solution, a solution composed of 11.8 parts of sodium n-octylbenzene-sulfonate and 150 parts of water was poured. A red solid matter precipitated was separated by filtration and thoroughly washed with water. The solid matter was dried to obtain 55.9 parts of Composition 3 composed of a hydrophobicity-imparted product of the Rhodamine dye, which is represented by the following formula (6), and aluminum silicate.

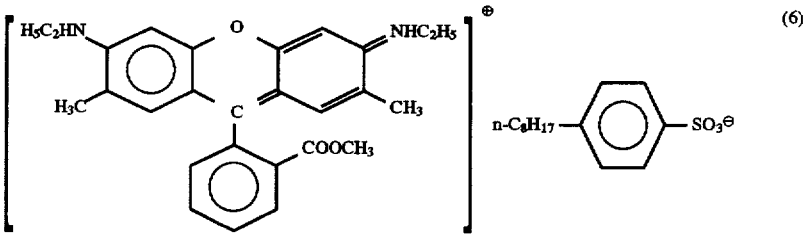

(6)

After a toner was then prepared in the same manner as in Example 1 except that Composition 1 was changed to Composition 3, its triboelectric charge level was measured. As a result, its charge level was found to be +20.0 μC/g.

The toner was charged into a developing device to conduct continuous copying, thereby performing an image test. As a result, it was found that a good image was obtained at the time of starting, its image quality remains unchanged even after copying of 50,000 sheets, and neither flying of the toner nor occurrence of offset was caused. Further, the good image quality was attained without being affected by both high-temperature and high-humidity environment and low-temperature and low-humidity environment.

Comparative Example 1

In 540 parts of hot water of 80° to 90° C., 18.8 parts of Rhodamine 6GCPN were dissolved under stirring. After 24 parts of aluminum silicate (OS-Clay, trade name, product of Sanyo Cray K.K.) were added to the solution, a solution composed of 7.8 parts of sodium p-toluene-sulfonate and 150 parts of water was poured. A red solid matter precipitated was separated by filtration and thoroughly washed with water. The solid matter was dried to obtain 45.5 parts of Composition 4 for comparison composed of a hydrophobicity-imparted product of the Rhodamine dye, which is represented by the following formula (7), and aluminum silicate.

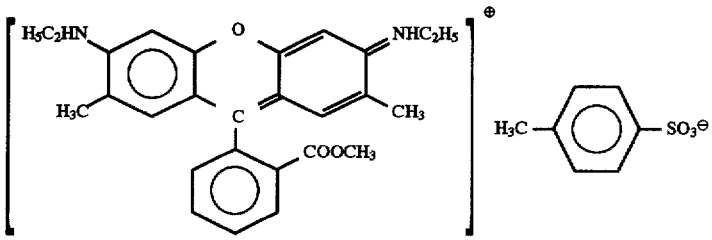

(7)

After a toner was then prepared in the same manner as in Example 1 except that Composition 1 was changed to Composition 4 for comparison, its triboelectric charge level was measured. As a result, its charge level was found to be +19.2 μC/g.

EXAMPLE 6

In 350 parts of hot water of 80° to 90° C., 12.1 parts of Rhodamine 6GCPN were dissolved under stirring. A solution composed of 9.0 parts of sodium dodecylbenzene-sulfonate and 100 parts of water was poured into the resultant solution. A red solid matter precipitated was separated by filtration and thoroughly washed with water. The solid matter was dried to obtain 20 parts of a hydrophobicity-imparted product (Compound (1)) of the Rhodamine dye, which is represented by the formula

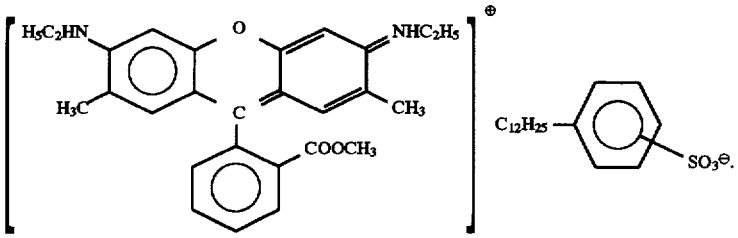

(8)

Then, 88 parts of a styrene-n-butyl methacrylate copolymer resin (Himer SBM-73F, trade name, product of Sanyo Chemical Industries, Ltd.) and 5 parts of low-molecular weight polypropylene (Viscol 550-P, trade name, product of Sanyo Chemical Industries, Ltd.), 5 parts of carbon black (#44, trade name, product of Mitsubishi Chemical K.K.) and 2 parts of Compound 1 were premixed, and then melted and kneaded. The thus-obtained melt was further ground and classified to obtain a toner having a particle diameter of 5 to 25 μm.

To 3 parts of the toner 97 parts of a carrier composed of iron powder (TEFV 200/300, trade name, product of Powdertech Corp.) was mixed to prepare a developer. After the developer was stirred, its triboelectric charge level was measured by means of a blow-off charge meter (manufactured by Toshiba Chemical Corporation). As a result, its charge level was found to be +22 μC/g.

The toner was charged into a developing device to conduct continuous copying, thereby performing an image test. As a result, it was found that a good image was obtained at the time of starting, its image quality remains unchanged even after copying of 50,000 sheets, and neither flying of the toner nor occurrence of offset was caused. Further, the good image quality was attained without being affected by both high-temperature and high-humidity environment and low-temperature and low-humidity environment.

EXAMPLE 7

In 540 parts of hot water of 80° to 90° C., 18.8 parts of Rhodamine 6GCPN were dissolved under stirring. After 33.0 parts of aluminum silicate (OS-Clay, trade name, product of Sanyo Cray K.K.) were added to the solution, a solution composed of 17.5 parts of sodium n-octadecylbenzene-sulfonate and 150 parts of water was poured. A red solid matter precipitated was separated by filtration and thoroughly washed with water. The solid matter was dried to obtain 66.0 parts of Composition 6 composed of a hydrophobicity-imparted product of the Rhodamine dye, which is represented by the following formula (9), and aluminum silicate.

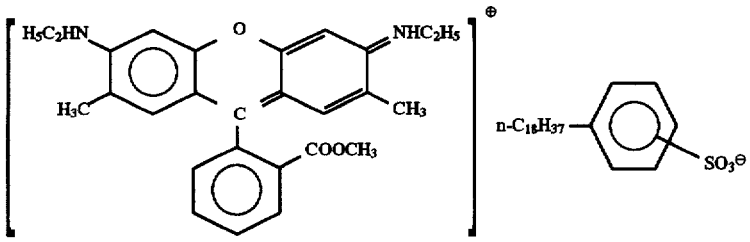

(9)

Then, 88 parts of a styrene-n-butyl methacrylate copolymer resin (Himer SBM-73F, trade name, product of Sanyo Chemical Industries, Ltd.) and 5 parts of low-molecular weight polypropylene (Viscol 550-P, trade name, product of Sanyo Chemical Industries, Ltd.), 5 parts of carbon black (#44, trade name, product of Mitsubishi Chemical K.K.) and 2 parts of Composition 6 were premixed, and then melted and kneaded. The thus-obtained melt was further ground and classified to obtain a toner having a particle diameter of 5 to 25 μm.

To 3 parts of the toner 97 parts of a carrier composed of iron powder (TEFV 200/300, trade name, product of Powdertech Corp.) was mixed to prepare a developer. After the developer was stirred, its triboelectric charge level was measured by means of a blow-off charge meter (manufactured by Toshiba Chemical Corporation). As a result, its charge level was found to be +21.2 μC/g.

The toner was charged into a developing device to conduct continuous copying, thereby performing an image test. As a result, it was found that a good image was obtained at the time of starting, its image quality remains unchanged even after copying of 50,000 sheets, and neither flying of the toner nor occurrence of offset was caused. Further, the same image quality as in the ordinary-temperature and ordinary-humidity environment was attained even in both high-temperature and high-humidity environment of 35° C. and 85% RH and low-temperature and low-humidity environment of 10° C. and 30% RH. Neither flying of the toner nor occurrence of offset was also caused even in such environments.

Comparative Example 2

In 540 parts of hot water of 80° to 90° C., 18.8 parts of Rhodamine 6GCPN were dissolved under stirring. After 31 parts of aluminum silicate (OS-Clay, trade name, product of Sanyo Cray K.K.) were added to the solution, a lake-forming agent prepared by adding 9.6 parts of sodium tungstate, 28.1 parts of sodium molybdate and 4.4 parts of sodium phosphate to 100 parts of water and further adding 28.8 parts of hydrochloric acid was poured. A red lake precipitated was separated by filtration and thoroughly washed with water. The lake was dried to obtain 68.6 parts of Composition 5 for comparison containing a compound represented by the formula

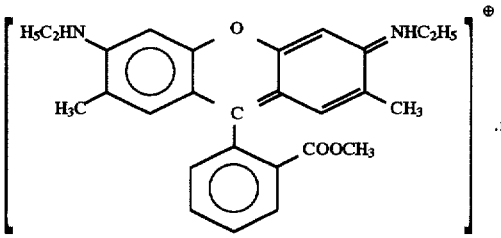

$$.1/4\{H_3[P(M_9O_7, W_2O_7)]_6\}_4^{\ominus}. \quad (10)$$

After a toner was then prepared in the same manner as in Example 1 except that Composition 1 was changed to Composition 5, its triboelectric charge level was measured. As a result, its charge level was found to be +3.5 μC/g.

Comparative Example 3

After a toner was prepared in the same manner as in Example 3 except that Composition 1 was changed to Composition 5, its triboelectric charge level was measured. As a result, its charge level was found to be −1.2 μC/g.

The results of Examples 1 to 6 and Comparative Examples 1 to 3 are collectively shown in Tables 1 and 2, respectively.

TABLE 1

| Ex. No. | Charge control agent No. | Resin | Carbon black | Charge level of toner (μC/g) | Stability to envi. | Image eval. (fog/fly of toner) |
|---|---|---|---|---|---|---|
| 1 | Composition 1 | A | #44 | +20.0 | A | A/A |
| 2 | Composition 2 | A | #44 | +19.2 | A | A/A |
| 3 | Composition 1 | B | ELFTEX-8 | +18.0 | A | A/A |
| 4 | Composition 2 | B | ELFTEX-8 | +18.0 | A | A/A |
| 5 | Composition 3 | A | #44 | +20.0 | A | A/A |
| 6 | Compound 1 | A | #44 | +22.0 | A | A/A |
| 7 | Composition 6 | A | #44 | +21.2 | A | A/A |

TABLE 2

| Ex. No. | Charge control agent No. | Resin | Carbon black | Charge level of toner (μC/g) | Stability to envi. | Image eval. (fog/fly of toner) |
|---|---|---|---|---|---|---|
| 1 | Composition 4 | A | #44 | +19.2 | B | B/B |
| 2 | Composition 5 | A | #44 | +3.5 | B | B/B |

TABLE 2-continued

| Ex. No. | Charge control agent No. | Resin | Carbon black | Charge level of toner (μC/g) | Stability to envi. | Image eval. (fog/fly of toner) |
|---|---|---|---|---|---|---|
| 3 | Composition 5 | B | ELFTEX-8 | −1.2 | B | B/B |

Note 1:
Explanation of abbreviations
Ex.: Example
Comp. Ex.: Comparative Example
eval.: evaluation
envi.: environment Note 2

Resin A: Styrene-n-butyl methacrylate copolymer resin (Himer SBM-73F, trade name, product of Sanyo Chemical Industries, Ltd.)

Resin B: Polyester resin (HP-313, trade name, product of The Nippon Synthetic Chemical Industry Co., Ltd.)

Carbon black #44: trade name, product of Mitsubishi Chemical K.K.

Carbon black ELFTEX-8: trade name, product of Cabot Company

Charge level: Saturated charge level (measured value after stirred for 2 hours)

Evaluation standard

A: Practicable without problems;

B: Causing problems in actual use

As apparent from the comparison of Examples with Comparative Examples, it is understood that when the hydrophobicity-imparted product of a xanthene-type dye or the composition of the hydrophobicity-imparted product and the inorganic pigment is used as a charge control agent, its dispersion in the binder resin becomes extremely good, and so it is possible for individual toner particles to have good charge properties, namely, an even charge level and excellent retention of charge. In keeping with this, the dispersion of the toner particles in the carrier is feasible in a short period of time, so that build-up of charge becomes faster, and high-speed copying hence becomes feasible. At the same time, the toners become elongated in service life and hard to be affected by environmental changes such as high-temperature and high-humidity, and low-temperature and low-humidity.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electrostatic image developing toner, which comprises a binder resin, a colorant and a charge control agent, wherein the charge control agent is a hydrophobicity-imparted product of a xanthene-type dye, which is represented by the general formula

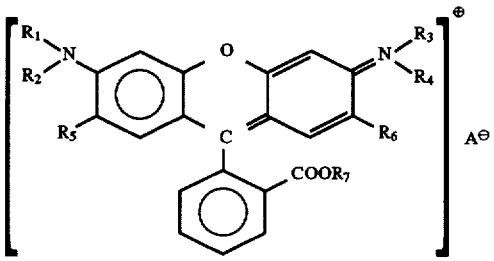

(1)

wherein $R_1$, $R_3$, $R_5$, $R_6$ and $R_7$ are independently hydrogen or a lower alkyl group, $R_2$ and $R_4$ are independently a lower alkyl group, and A is a group represented by the general formula

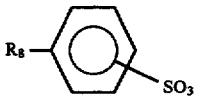

(2)

in which $R_8$ is an alkyl group having 8 to 37 carbon atoms, or the general formula

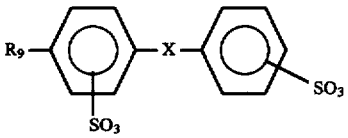

(3)

in which $R_9$ is an alkyl group having 1 to 37 carbon atoms, and X is O, S, NH or $CH_2$, and is contained in a proportion of 0.05 to 10 parts by weight per 100 parts by weight of the binder resin.

2. The toner according to claim 1, wherein in the formula (2) $R_8$ is alkyl having 8 to 20 carbon atoms.

3. The toner according to claim 1, wherein in the formula (2) $R_8$ is octyl or dodecyl.

4. The toner according to claim 1, wherein in the formula (2) $R_8$ is dodecyl.

5. The toner according to claim 1, wherein in the formula (3) $R_9$ is alkyl having 8 to 20 carbon atoms.

6. The toner according to claim 1, wherein in the formula (3) $R_9$ is dodecyl.

7. The toner according to claim 1, wherein in the formula (3) X is 0.

8. An electrostatic image developing toner, which comprises a binder resin, a colorant and a charge control agent, wherein the charge control agent is prepared from a hydrophobicity-imparted product of a xanthene-type dye, which is represented by the general formula

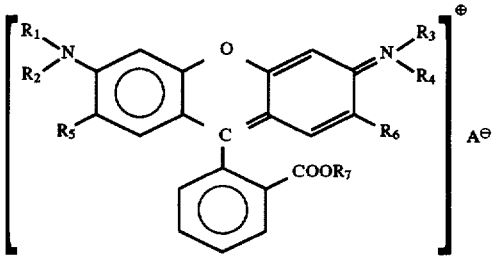

(1)

wherein $R_1$, $R_3$, $R_5$, $R_6$ and $R_7$ are independently hydrogen or a lower alkyl group, $R_2$ and $R_4$ are independently a lower alkyl group, and A is a group represented by the general formula

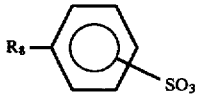

(2)

in which $R_8$ is an alkyl group having 8 to 37 carbon atoms, or the general formula

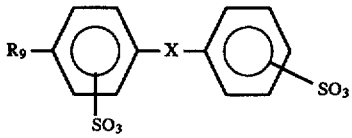

(3)

in which $R_9$ is an alkyl group having 1 to 37 carbon atoms, and X is O, S, NH or $CH_2$, and an inorganic pigment, and is contained in a proportion of 0.05 to 10 parts by weight per 100 parts by weight of the binder resin.

9. The toner according to claim 8, wherein in the formula (2) $R_8$ is alkyl having 8 to 20 carbon atoms.

10. The toner according to claim 8, wherein in the formula (2) $R_8$ is octyl or dodecyl.

11. The toner according to claim 8, wherein in the formula (2) $R_8$ is dodecyl.

12. The toner according to claim 8, wherein in the formula (3) $R_9$ is alkyl having 8 to 20 carbon atoms.

13. The toner according to claim 8, wherein in the formula (3) $R_9$ is dodecyl.

14. The toner according to claim 8, wherein the inorganic pigment in the charge control agent composition is at least one selected from the group consisting of calcium carbonate, magnesium carbonate, barium sulfate, calcium sulfate, magnesium hydroxide, aluminum hydroxide, calcium silicate, aluminum silicate, zinc silicate and magnesium silicate.

15. The toner according to claim 14, wherein the inorganic pigment is aluminum silicate.

* * * * *